US012096803B2

(12) United States Patent
Hamilton et al.

(10) Patent No.: US 12,096,803 B2
(45) Date of Patent: Sep. 24, 2024

(54) E-CIGARETTE VAPORIZER CARTRIDGE FILLING DEVICE

(71) Applicant: Anthony Hamilton, Tucson, AZ (US)

(72) Inventors: Anthony Hamilton, Tucson, AZ (US); John K Waterman, Tempe, AZ (US)

( * ) Notice: Subject to any disclaimer, the term of this patent is extended or adjusted under 35 U.S.C. 154(b) by 442 days.

(21) Appl. No.: 17/514,518

(22) Filed: Oct. 29, 2021

(65) Prior Publication Data

US 2022/0132939 A1 May 5, 2022

Related U.S. Application Data

(60) Provisional application No. 63/109,443, filed on Nov. 4, 2020.

(51) Int. Cl.
*A24F 40/70* (2020.01)
*B65B 3/12* (2006.01)
*B65B 3/30* (2006.01)

(52) U.S. Cl.
CPC ..... *A24F 40/70* (2020.01); *B65B 3/12* (2013.01); *B65B 3/30* (2013.01)

(58) Field of Classification Search
CPC ..... A24F 40/70; A24F 40/40; A24F 40/42; A24F 40/80; B65B 3/12; B65B 3/30
USPC ..... 131/329
See application file for complete search history.

(56) References Cited

U.S. PATENT DOCUMENTS 3,835,897 A * 9/1974 Gess ..... B65C 3/08 141/98
3,880,211 A * 4/1975 Gess ..... B65B 3/12 141/183
7,703,483 B2 * 4/2010 Hartman ..... B65B 3/003 141/27
7,922,104 B2 * 4/2011 Zlotnik ..... A61L 9/127 422/123
8,839,827 B2 * 9/2014 Heatley ..... B65B 3/12 141/378
9,877,521 B1 * 1/2018 Gillis ..... A24F 40/42
10,440,989 B2 * 10/2019 Gardella ..... B65B 39/12
10,611,505 B2 * 4/2020 Ampolini ..... B65B 3/14
10,781,001 B2 * 9/2020 Min ..... A61M 1/34
10,973,996 B2 * 4/2021 Nagar ..... F25B 21/04
11,166,490 B2 * 11/2021 Gardella ..... B65B 29/00
11,484,898 B2 * 11/2022 Woodbine ..... B05B 11/0054
(Continued)

FOREIGN PATENT DOCUMENTS

CN 110709063 A * 1/2020 ..... A24B 15/00

*Primary Examiner* — Abdullah A Riyami
*Assistant Examiner* — Vladimir Imas
(74) *Attorney, Agent, or Firm* — Accelerate IPLLC

(57) ABSTRACT

A vaporizer cartridge filling device can comprise a fluid dispenser comprising a dispensing end and a driving end and a frame. The driving end can comprise a motor connected to the frame by a motor mount wherein the motor is connected to a coupling connected to a threaded rod. A support track can be attached to the motor mount and the frame by one or more surface brackets wherein the support track has a rail where at least one bearing can moves on. The dispensing end comprises a carriage that is connected to a syringe push block wherein the push block holds a syringe handle and the syringe handle is attached to a syringe plunger wherein the syringe push block and syringe handle moves as the motor rotates the threaded rod and the carriage translates up or down on the threaded rod.

13 Claims, 9 Drawing Sheets

(56) References Cited

U.S. PATENT DOCUMENTS

| | | | | |
|---|---|---|---|---|
| 11,565,056 | B2 * | 1/2023 | Eggert | A61M 5/5086 |
| 11,603,223 | B2 * | 3/2023 | Ampolini | B65B 11/52 |
| 11,612,189 | B2 * | 3/2023 | Chao | B65B 3/003 131/328 |
| 11,744,965 | B2 * | 9/2023 | Alarcon | A61M 15/0001 131/299 |
| 11,866,312 | B1 * | 1/2024 | Ellis | B65B 37/06 |
| 2002/0159915 | A1 * | 10/2002 | Zelina | B65B 55/025 422/305 |
| 2006/0011262 | A1 * | 1/2006 | Stienen | A61L 2/208 141/147 |
| 2009/0090431 | A1 * | 4/2009 | Yacko | G01F 11/029 141/192 |
| 2011/0061765 | A1 * | 3/2011 | Hartman | B65B 3/003 141/2 |
| 2018/0105294 | A1 * | 4/2018 | Abboud | B65B 3/003 |
| 2019/0166913 | A1 * | 6/2019 | Trzecieski | A61M 15/06 |
| 2019/0307170 | A1 * | 10/2019 | Zarifian | G05D 11/13 |
| 2020/0000143 | A1 * | 1/2020 | Anderson | G06F 18/22 |
| 2020/0022416 | A1 * | 1/2020 | Alarcon | A24F 40/57 |
| 2020/0221769 | A1 * | 7/2020 | Davis | B23P 19/10 |
| 2020/0221778 | A1 * | 7/2020 | Trzecieski | A24F 40/10 |
| 2021/0068444 | A1 * | 3/2021 | Alarcon | A24F 40/20 |

* cited by examiner

E-CIGARETTE VAPORIZER CARTRIDGE FILLING DEVICE

CROSS REFERENCE TO RELATED APPLICATIONS

The present application claims the benefit under 35 U.S.C. 119 of U.S. Provisional Patent Application Ser. No. 63/109,443 filed Nov. 4, 2020. The U.S. Provisional Patent Application Ser. No. 63/109,443 is hereby incorporated by reference in its entirety.

FIELD OF THE INVENTION

The present specification relates to a device for filling cartridges more particular a device for filling liquids into vaporizer cartridges for e-cigarettes.

BACKGROUND OF THE INVENTION

Vaping devices are used to deliver a substance to a user by creating an aerosol as the user inhales. Typically, vaping devices consist of a cartridge or reservoir pod, which holds a liquid solution containing varying amounts of nicotine, CBD, flavorings and other compounds that may be inhaled by a user. A heating element atomizes the liquid as the user inhales. The heating element is activated when the user puffs on the vaping device. For e-cigarettes, the reservoirs usually are a mixture of propylene glycol, glycerin, nicotine, and flavorings. As the user inhales from the e-cigarette over time the reservoir empties and needs to be replaced. The user can exchange the empty cartridge with a new, full cartridge. The quantity of liquid held within the cartridge is usually quite small depending on the size of the cartridge. Filling devices usually comprise a discharge nozzle for filling the cartridge wherein a specified quantity of liquid can be injected into the cartridge.

Current cartridge filling machines are either operated manually using a syringe filling the cartridge to a fill point or are automatic requiring extensive setup to fill the cartridges to the desired point. Filling manually is labor intensive and inconsistent, whereas using an automatic filling machine requires the user to set the fill point which cannot be quickly changed or updated for different reservoir volumes. In addition, the assembly path is made for only one cartridge size and requires major changes within the system if a larger or smaller cartridge size is being filled.

Therefore, there is a need for a device that eliminates human error within the filling process and allows for easy setup wherein the user can easily adapt the device to different cartridge sizes.

BRIEF SUMMARY OF THE INVENTION

In embodiments a vaporizer cartridge filling device can comprise a frame supporting a fluid dispenser, a microcontroller that controls the fluid dispenser and a user interface. The fluid dispenser may comprise a reservoir that drains to a tube, a syringe with a plunger, the syringe coupled to the tube and to a motor that may be a stepper motor and that operates a threaded rod to move the plunger as the motor rotates the threaded rod.

The syringe further has a syringe body and syringe tip and the syringe body and syringe tip may be held stationary as the syringe plunger moves inside of the syringe body. A bottom switch and a top switch may be attached to the frame wherein a carriage can contact, activate and deactivate the bottom switch and the top switch setting a bottom and top limit. The micro-controller may receive input from the bottom switch and the top switch and calibrates the volume dispensed by the plunger. the micro-controller may also run a cleaning cycle wherein the motor moves the syringe plunger until a cleaning solution is flushed through the reservoir, the tube, and the syringe body.

A first heating element can contact and heat the fluid in the reservoir and a second heating element can contact and heat the fluid in the tube. In a particular embodiment, the first heating element is set to 85 degrees C. and the second heating element is set to 75 degrees C.

In some embodiments, a method for operating a vaporizer cartridge filling device is provided that provides a frame supporting a fluid dispenser, a microcontroller that controls the fluid dispenser and a user interface, the fluid dispenser comprising a reservoir that drains to a tube, a valve that allows the fluid to flow through the fluid dispenser in one directions, a syringe comprising a plunger, the syringe coupled to the tube and to a motor that is coupled to a threaded rod, wherein the plunger moves as the motor rotates the threaded rod;

A volume to be dispensed from the syringe may be calibrated by defining the volume by a lower limit of travel and an upper limit of travel of the plunger and running a program that sets at least one of the lower limits and the top limit using positional feedback to precisely control the volume. At least one of the lower limits and the upper limit defining the volume is saved for repeated operation.

The speed may be set to dispense the volume of fluid from the syringe by moving the plunger from the lower limit to the upper limit to draw the liquid from the reservoir to the syringe and moving the plunger back to the lower limit to dispense the fluid from the syringe. At least one of the draw and the dispensation of the fluid may be activated by operating a switch that initiates movement of the plunger. The system may be cleaned by loading a cleaning solution into the reservoir and allowing the fluid dispenser to continuously purge the system with the cleaning solution until the reservoir is empty or for a predetermined time period.

The cleaning solution may be alcohol and the speed may be set to 1×, 2×, 3×, 5×, 7×, or 10×. Strain on the motor may be determined by detecting a viscosity of the fluid wherein the strain on the motor increases with higher viscosity fluid. The volume to be dispensed may be precisely controlled using a shaft encoder to independently count motor pulses. An accelerometer may be used, and linear displacement computed by integrating the accelerometer for precisely dispensing the volume into the cartridge. The volume may also be controlled by using a linear position reader based on a resistive potentiometer reader, inductive reader, encoded magnetic strip reader or optical strip reader.

In some embodiments, a method for troubleshooting a vaporizer device is provided. The device may be calibrated by computing a desired volume to dispense, subtracting, or adding a fraction of the volume from the calibrated dispense volume, and bumping a motor which adds or subtracts the amount of the volume of fluid by the calibrated amount. The volume may be between about 0.02 mL or 0.03 mL and each bump of the motor may be at least 20 motor pulses per bump.

In other embodiments, a fluid dispenser is provided comprising a dispensing end and a driving end and a frame. The driving end can comprise a motor connected to the frame by a motor mount wherein the motor is connected to a coupling connected to a threaded rod. A support track can be attached to the motor mount and the frame by one or more surface brackets wherein the support track has a rail where at least one bearing can move on.

The dispensing end comprises a carriage that is connected to a syringe push block wherein the push block holds a syringe handle and the syringe handle is attached to a syringe plunger wherein the syringe push block and syringe handle moves as the motor rotates the threaded rod and the carriage translates up or down on the threaded rod. A liquid reservoir can have an outlet end wherein the outlet end is attached to a tube wherein the tube reaches from the reservoir to the syringe wherein the liquid reservoir and tube has a heating element wrapped around it.

A micro-controller unit (MCU) can control the operations of the vaporizer cartridge filling device. The motor can be a stepper motor. The syringe can further comprise a syringe body and syringe tip wherein the syringe body and syringe tip is stationary, and the syringe plunger moves inside of the syringe body. The device can further comprise a bottom switch and a top switch that is attached to the frame wherein the carriage can come into contact and activate and deactivate the bottom switch and top switch setting a bottom and top limit. The micro-controller unit receives and read inputs from the bottom switch and the top switch and calibrates the device to the syringe volume to the amount of fluid being dispensed. The micro-controller unit runs a cleaning cycle wherein the motor moves the syringe plunger until a cleaning solution is dispersed from the reservoir, the tube, and the syringe body. Heating element on the reservoir is set to 85 degrees C. and on the tubing and syringe set to 75 degrees C.

A method for operating a vaporizer device comprising calibrating the device by setting the volume of a syringe and running a program that sets the bottom limit and the top limit, loading liquid in a reservoir, setting a speed to dispense a liquid from a syringe wherein a liquid is withdrawn from the reservoir by the dispensing end as a motor moves the syringe plunger up thus filling a syringe body, activating the device by an activation switch wherein the motor is activate and the syringe plunger is pushed down into the syringe body expelling the fluid from the syringe body into an empty cartridge placed below a syringe tip by a user and cleaning the reservoir after use by setting an MCU to continuously purge the system with a cleaning solution until the reservoir is empty. The cleaning solution is alcohol. The speed is set to 1×, 2×, 3×, 5×, 7×, 10× for dispense cycle time from roughly 700 milliseconds to 7 seconds. Detecting a strain on the motor by detecting a viscosity of the fluid wherein the strain on the motor increases with higher viscosity fluid.

Certain aspects disclosed herein include a method for troubleshooting an e-cigarette vaporizer device comprising calibrating a device by computing the fraction of a mL of the dispensed amount. Subtracting or adding a fraction of the mL from the calibrated dispense amount. Bumping a motor which adds or subtracts the amount of the mL of fluid to get the calibrated amount. The mL is substantially between 0.02 mL or 0.03 mL but can be at most 0.01 mL to at most 0.50 mL. Each bump of the motor is at least 20 motor pulses per bump.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth in the specification. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of filling a e-cigarette cartridge, without also reciting in such phrases any structure, material or act in support of the function. Thus, even when the claims recite a "means for performing the function of filling a e-cigarette cartridge, step for performing the function of filling a e-cigarette cartridge," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Figure 1:
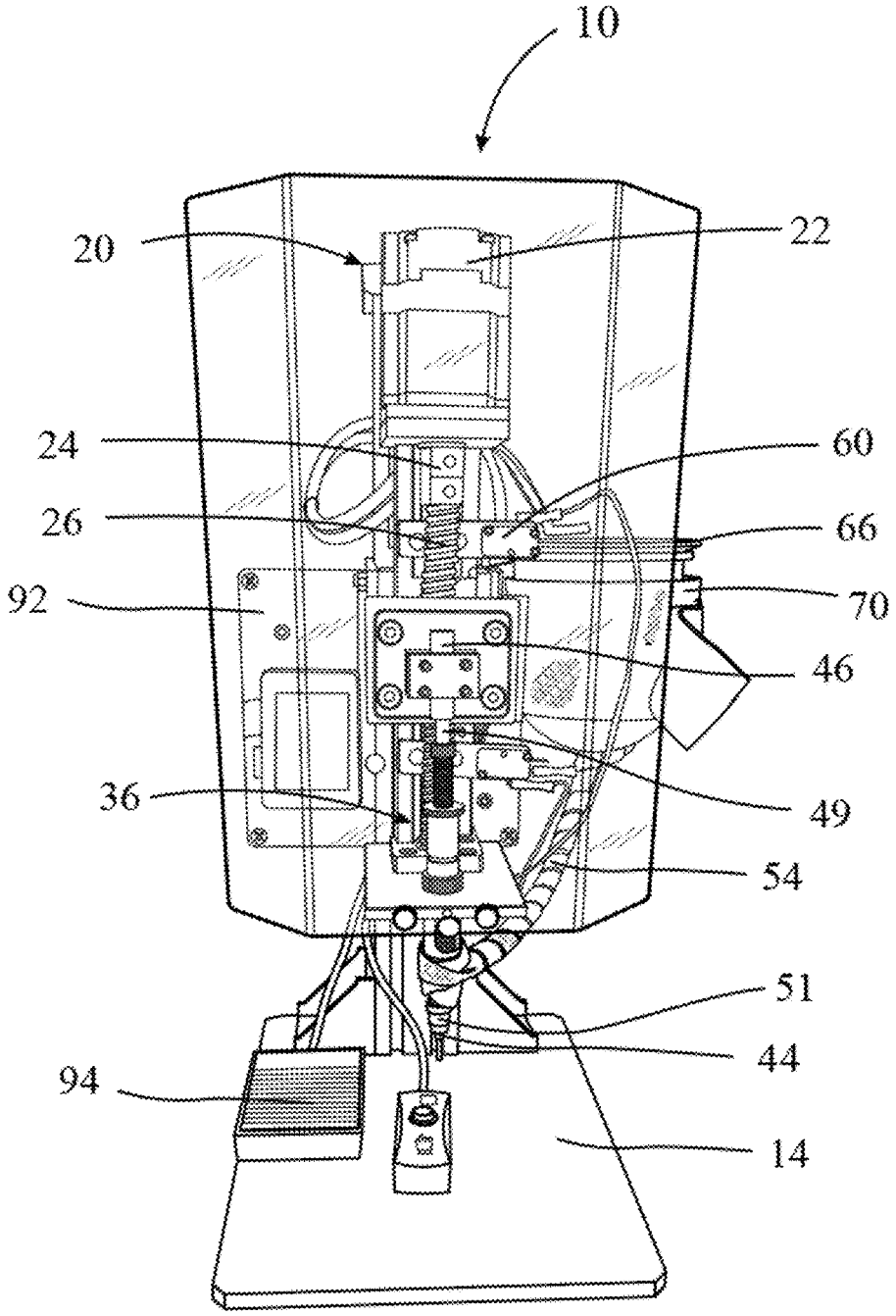
FIG. 1 is a front view of the vaporizer cartridge filling device in accordance to one, or more embodiments.
Figure 2:
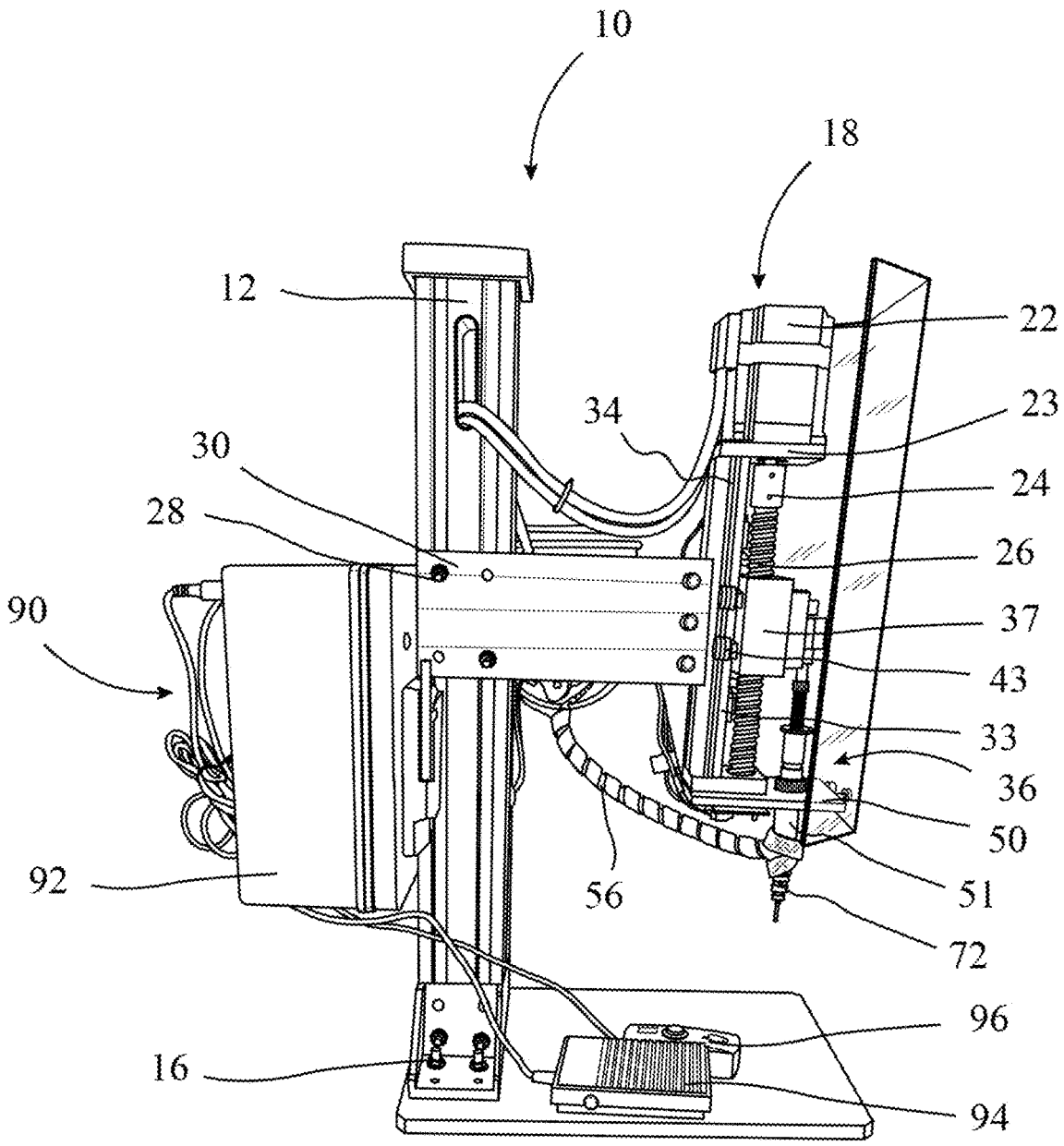
FIG. 2 is a left side view of the vaporizer cartridge filling device in accordance to one, or more embodiments.
Figure 3:
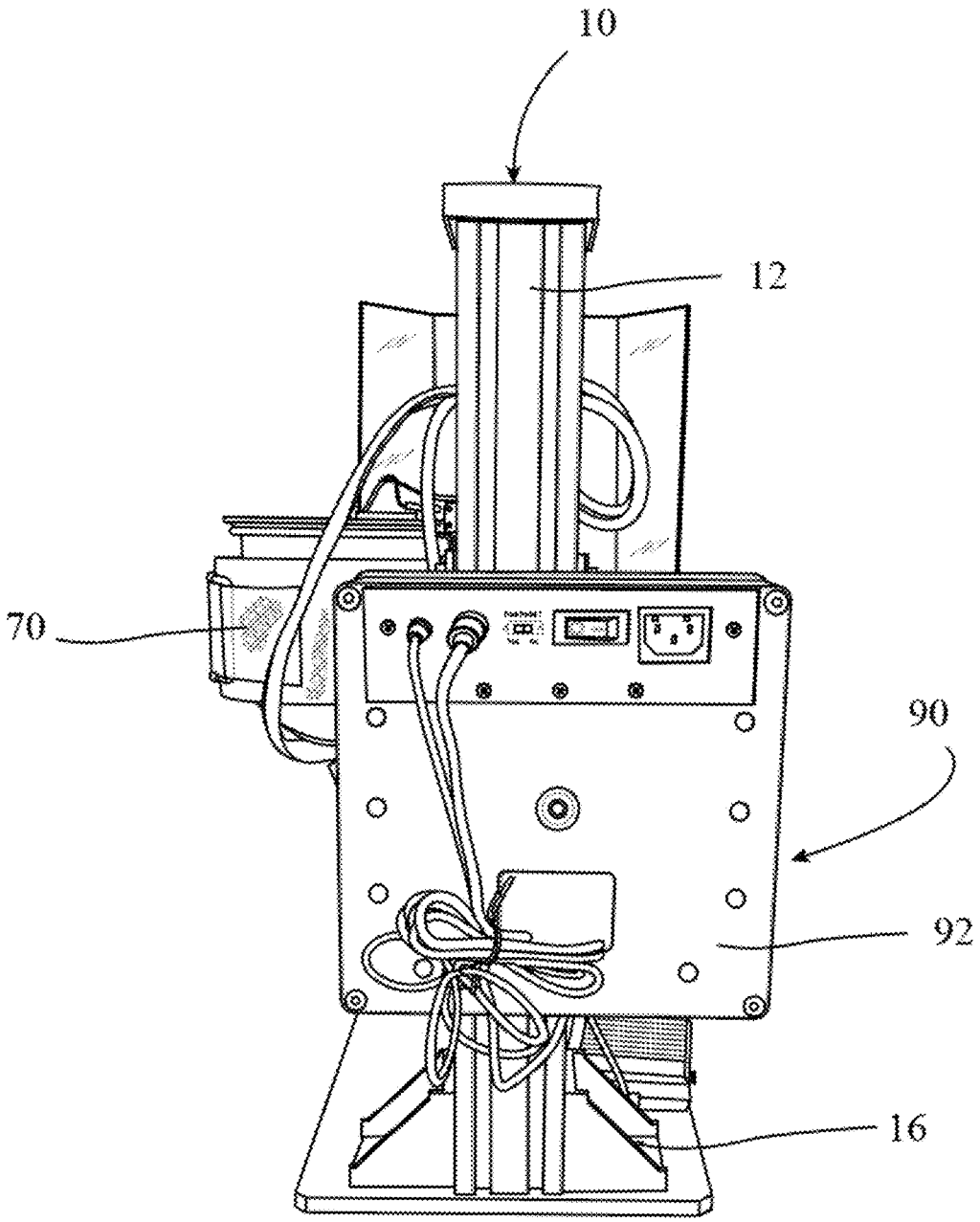
FIG. 3 is a back view of the vaporizer cartridge filling device in accordance to one, or more embodiments.
Figure 4:
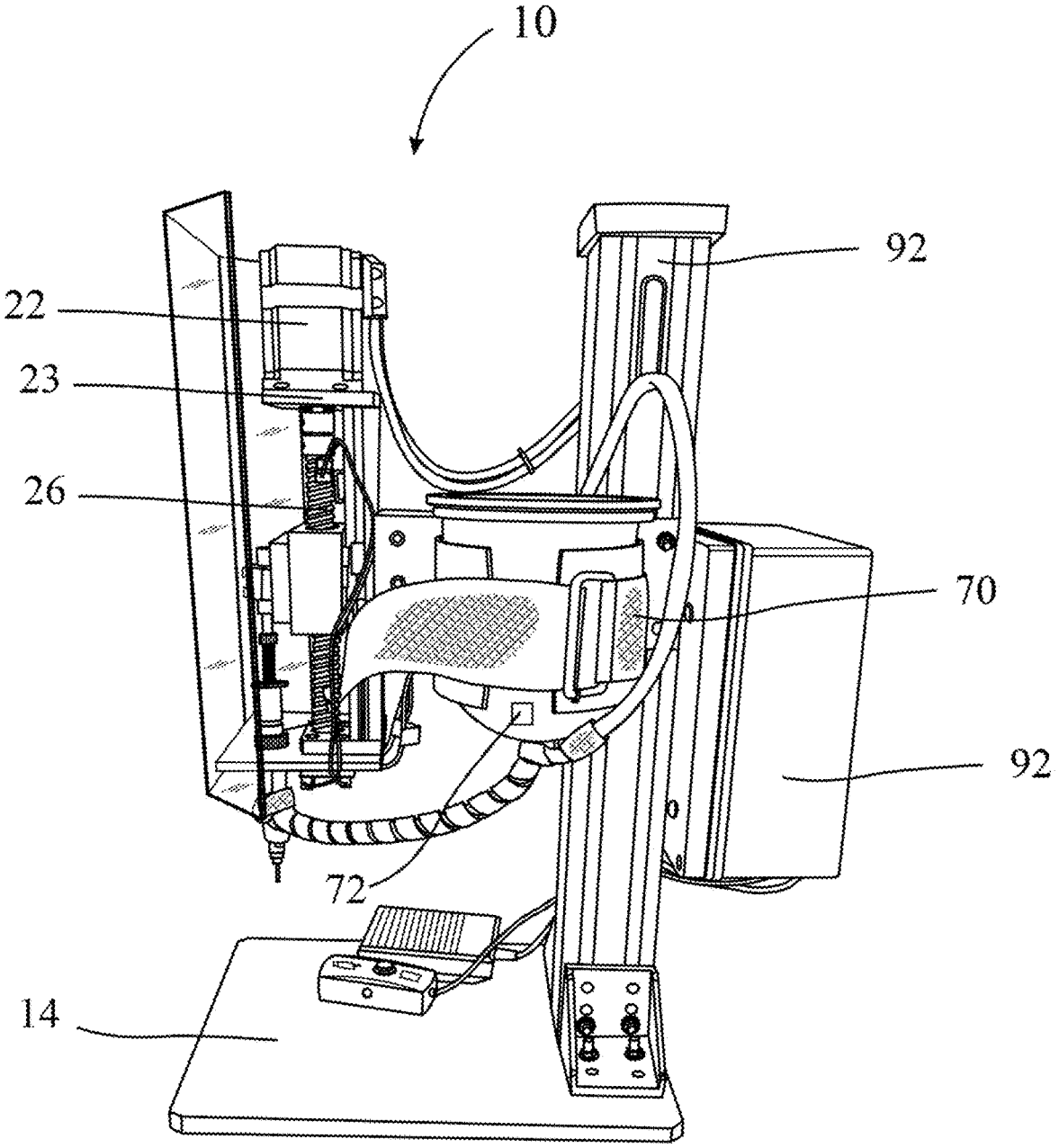
FIG. 4 is a right side view of the vaporizer cartridge filling device in accordance to one, or more embodiments.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Referring initially to FIGS. 1-6 a vaporizer cartridge filling device is shown generally 10. The vaporizer cartridge filling device 10 can comprise a frame 12 that supports a fluid dispenser 18 having a driving end 20 and a dispensing end 36. The frame 12 can comprise a base 14 wherein the base can support the frame by one or more fasteners 16. The base 14 can be a plate manufactured from carbon steel, stainless steel, aluminum, plastic or the like. In certain embodiments, the base 14 can comprise one or more mounts (not shown) attached to the bottom of the base wherein the mounts can be adjustable in height to level the vaporizer cartridge filling device 10. The mounts (not shown) can be for example, bumpers, feet, pads, leveling mounts, or the like.

Figure 5:
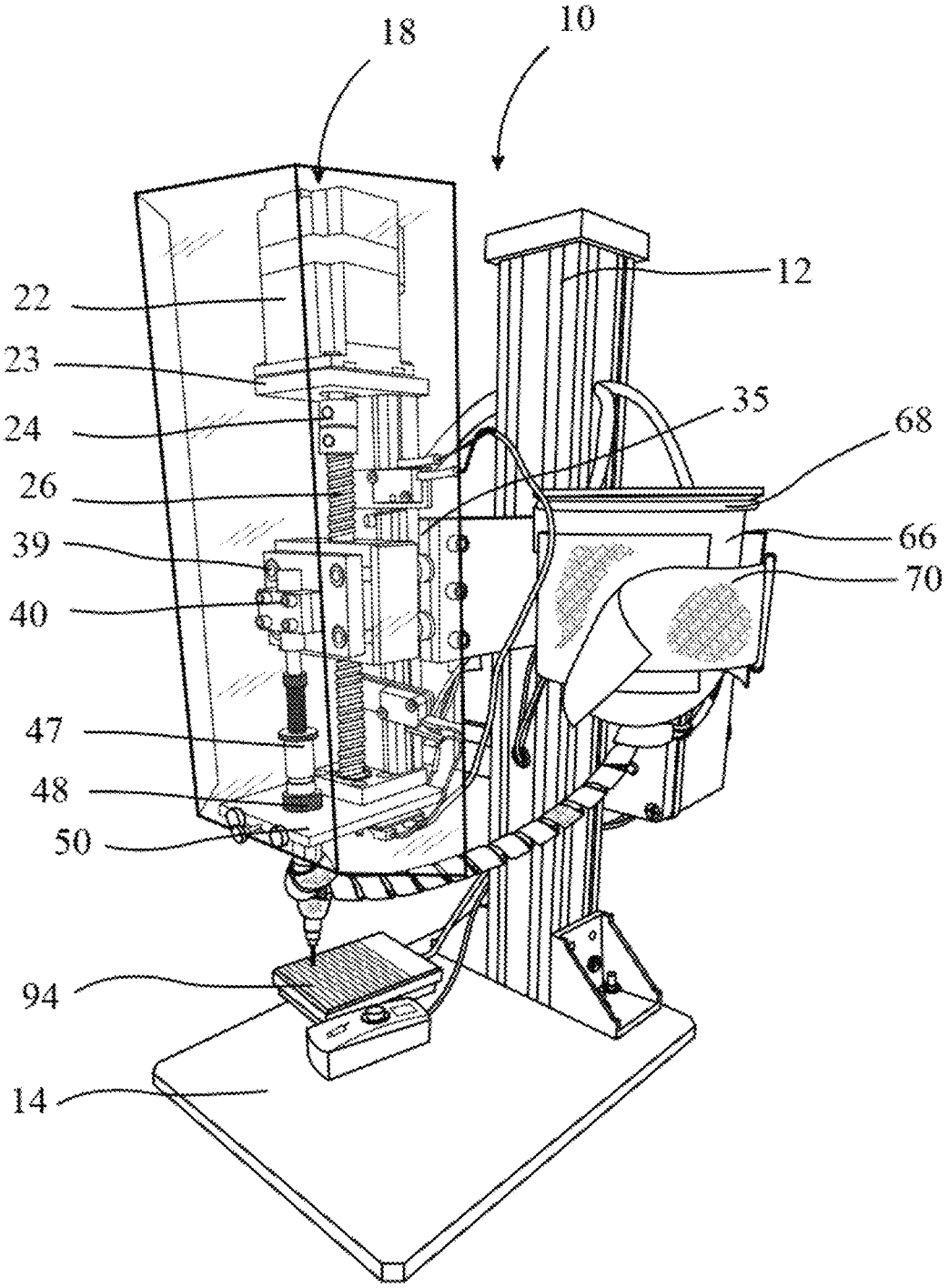
FIG. 5 is a right isometric view of the vaporizer cartridge filling device in accordance to one, or more embodiments.

The driving end 20 can comprise a motor 22 attached to the top of a motor mount 23 wherein the motor mount can be attached to the top of a support track 34 by one or more fasteners (not shown). The support track 34 can be attached to a support block 35 which can be attached to one or more mounting brackets 30 which attaches to the frame 12 through one or more fasteners 28 as shown in FIG. 5. The mounting brackets 30 can slide vertically on the frame 12 adjusting the fluid dispenser 18 height to allow for different types of cartridges and quantity of cartridges. In certain embodiments, the support bracket fasteners 28 can include one or more handles wherein the handles can be locking handles that can lock the mounting bracket 30 onto the frame 12 when at a user's specified height and then released when height adjustment is needed. The handles (not shown) can be, for example, a cam handle, locking handle, crank handle, knobs, or the like.

In embodiments, the motor 22 can be attached to the motor mount 23 by one or more fasteners (not shown) wherein the motor mount can have a thru hole (not shown) wherein the motor's shaft can protrude through the thru hole. A coupling 24 can be attached to the motor's 22 shaft by one or more set screws wherein the coupling can be removably or permanently attached to the motor's shaft. The motor 22 can be, for example, a brushless DC electric motor, permanent magnet stepper, bipolar and unipolar, servo motor, variable reluctance stepper, hybrid synchronous stepper, shunt DC motor, compound DC motor, or the like. In a particular embodiment, the motor 22 can be a stepper motor that can make micro-rotations to allow for the user to finely adjust the fluid output. The coupling 24 can be, for example, a rigid shaft coupling, flexible shaft coupling, u-joint, shaft adapter, torque-limiting shaft couplings, or the like.

Figure 6:
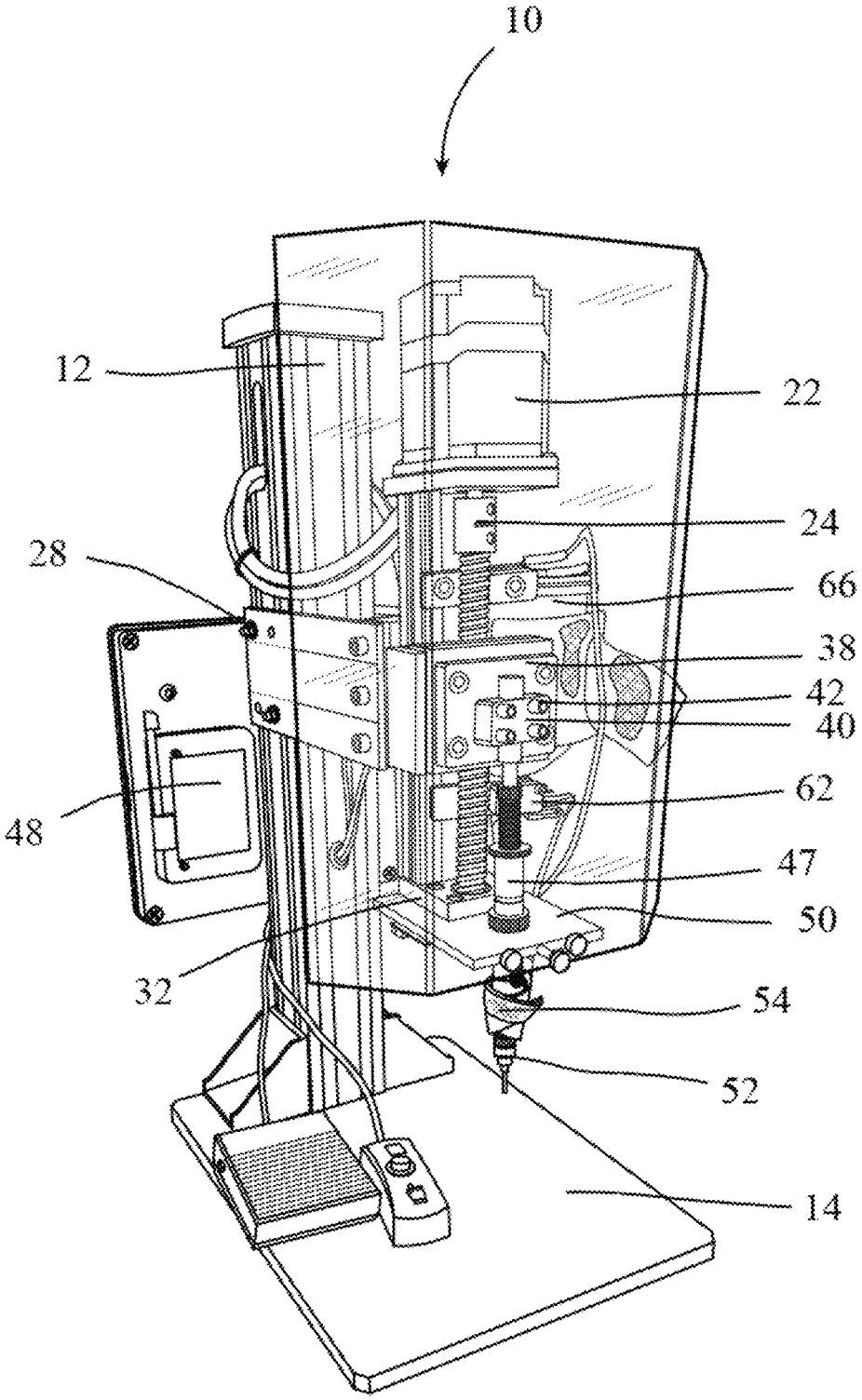
FIG. 6 is a left isometric view of the vaporizer cartridge filling device in accordance to one, or more embodiments.

On the opposing end of the coupling 24 a threaded rod 26 can be attached to the coupling wherein the threaded rod can be an acme screw, lead screw, ball screw, or the like. On the opposing end of the threaded rod 26, the threaded rod can be attached to an end support 32 wherein the threaded rod can rotate freely within the end support as shown in FIG. 6. The end support 32 can be coupled to the support track 34 wherein the send support can keep the threaded rod 26 captured between the end support and the coupling 24. The end support 32 can be such as, for example, an end support for radial loads, an end support for thrust loads, ball bearings, or the like wherein the end support can support any load distributed through the threaded rod 26.

The dispensing end 36 can further comprise a carriage 37 wherein the carriage can be threaded onto the threaded rod 26 and can move axially on the threaded rod 26 as the motor 22 turns the coupling 24 and the threaded rod. The carriage 37 can be any shape of size, but in the preferred embodiment the carriage is a square block with a threaded hole down the center wherein the threaded hole can be the opposing female threads to the threaded rod's 26 thread pitch. The carriage 37 can further comprise at least two bearing 43 located on at least two opposing sides of the carriage wherein the bearing can move axially on the support track 34. The support track 34 can have a rail 33 on at least one side wherein the support track can guide the carriage 37 on a linear path as the motor 22 moves the threaded rod 26 moving the carriage axially. In certain embodiments, the carriage 37 can have a bearing 43 in the middle of the carriage and a rail can be in the middle of the support track 34. In embodiments, a bearing 43 can be, for example one or more roller bearings, sleeve bearings, track rollers, v-groove rollers, drive rollers, telescoping slides, or the like. The carriage 37 can be attached to a syringe push block 38 wherein the syringe push block is attached by one or more fasteners 39. In other embodiments the carriage 37 and syringe push block 38 can be one piece wherein the syringe push block 38 is incorporated into the carriage.

The dispensing end 36 can further comprise a syringe 44 wherein the syringe can comprise a syringe handle 46, a syringe body 47, a syringe plunger 49, a syringe nut 48 and a syringe tip 52. The syringe 44 can be any suitable syringe body, and in the preferred embodiment the syringe can be Allflex 2 ml automatic syringe tube feed with a glass window and a stainless-steel body to allow for fluid visibility. The syringe push block 38 can have the syringe handle clamp 40 attached to it by one or more fasteners 42 wherein a syringe handle 46 can be captured by the syringe push block and the syringe handle clamp as shown in FIG. 6. As the motor 22 rotates the threaded rod 26 the carriage 37 moves axially up or down on the threaded rod depending upon the rotation of the motor and the input of the user filling a cartridge (not shown) or purging the system, the carriage moves the syringe push block 38 and syringe clamp handle 40 which in turn moves the syringe handle 46 wherein the syringe handle pushes the liquid out through the syringe tip 52 into the cartridge. All of the components of the syringe 44 are stationary besides the syringe handle 46 and syringe plunger 49 which can move within the syringe body 47 expelling or filling the syringe with fluid or a cleaning solution inside the syringe body.

The syringe body 47 can be attached to the syringe support 50 by one or more syringe nuts 48 which can be adjusted along the syringe body and the syringe support 50 adding an additional adjustment for height and in other embodiments the syringe can be attached directly to the frame 12 by, for example, a loop clamp, a fastener, a pipe clamp, rail clamp, or the like. In certain embodiments, the syringe handle 46 can be omitted and the syringe plunger 49 can be attached directly to the syringe push block 38, or the syringe push block can be omitted, and the syringe plunger can be attached directly to the carriage 37.

Figure 11:
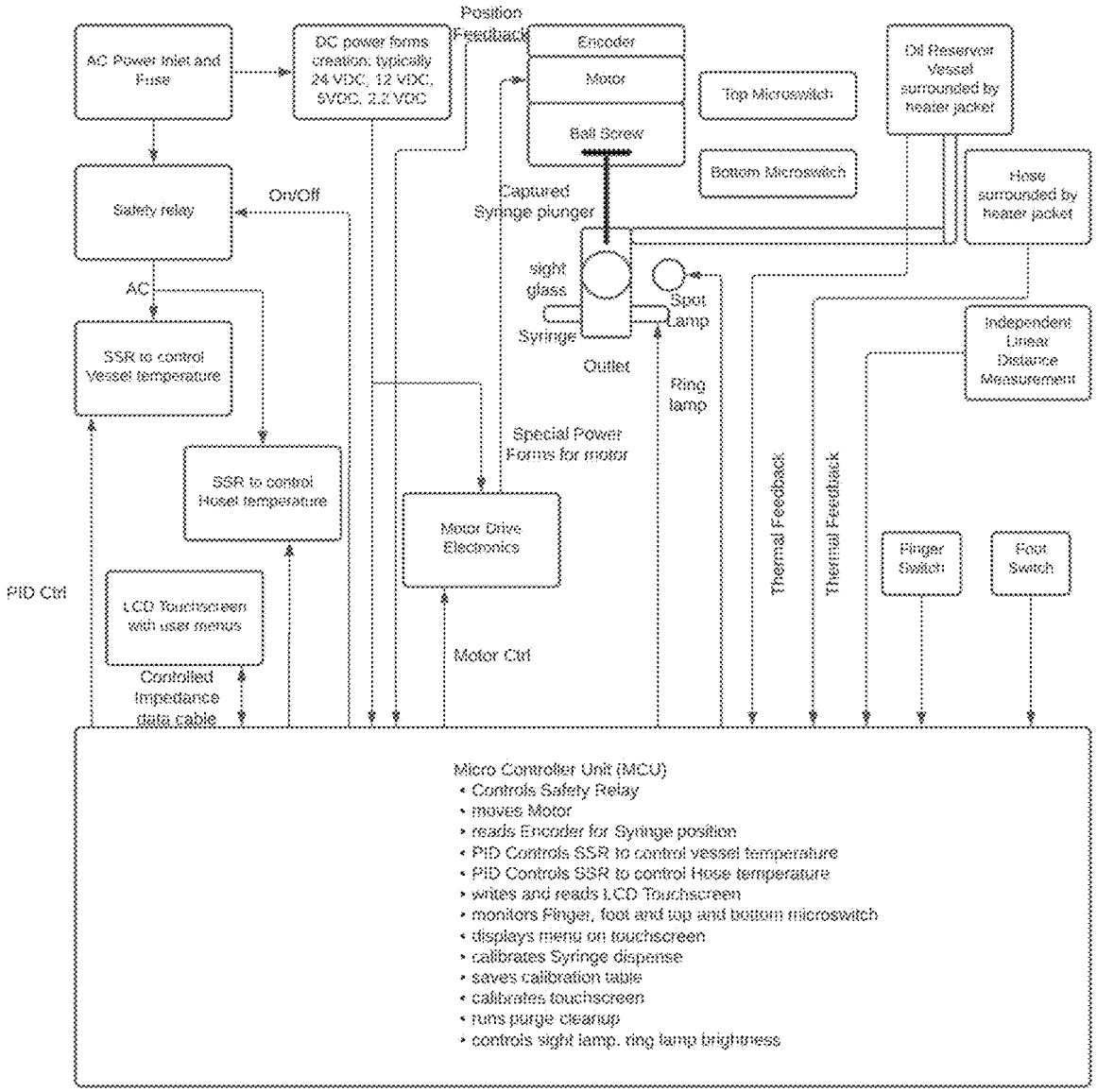
FIG. 11 is a flow chart of the vaporizer cartridge filling device in accordance to one, or more embodiments.

For increased accuracy of the dispense volume, the motor 22 can have a shaft encoder 25 placed along its shaft, in the preferred embodiment this the shaft encoder is located behind the motor but can be in any location near the motor as shown in FIG. 11. The shaft encoder 25 reads the threaded rod 26 rotation of the threaded rod 26 and does not rotate the shaft like the motor does, but rather reads the shaft rotation independently. The rotations from the threaded rod 26 can lag and once the motor pulses have finished, the thread rod is often still rotating, and the shaft encoder detects the motion of the threaded rod. For precision, the shaft encoder 25 pulses can be counted by the MCU 92 using polling, or more preferably using interrupts as shown in FIG. 11. The dispenser accuracy allows the user to fill the cartridge only to the specified volume without adding extra spill over and fluid waste. In another embodiment an accelerometer can be used to accurately dispense volumes to determine the syringe push block 38 linear position, and as a consequence, the syringe plunger 49 linear position. In yet another embodiment to achieve accuracy in dispensing is to use linear encoder 82, as shown in FIG. 11, to determine the syringe push block 38 linear position, and the syringe plunger 49. Such encoders can be potentiometer-based such as HGSI's LPPS-22 which can span 25 mm to 300 mm linear displacement. Other technologies such as inductive-based HGSI's ILPS-45 for 75 mm displacement have longer lifetimes but have shorter range. These more traditional technologies are more expensive but are much easier to program.

In another embodiment to achieve accurate dispense volumes a magnetic strip reader (not shown) can be used to determine the syringe push block 38 linear position, and as a consequence, the syringe plunger 49. This technology is often used in the machine tool industry for digital readout (DRO) of a machine spindle's location. In yet another embodiments to achieve accurate dispense volumes an optical strip reader can be used to determine the syringe push block 38 linear position, and as a consequence, the syringe plunger 49.

The vaporizer cartridge filling device 10 can further comprise a reservoir 66 that can be connected to the frame 12 by a reservoir attachment bracket 68. The reservoir 66 can be wrapped or coated with a heating element 70 wherein the heating element can keep the contents within the reservoir at a specified set temperature. The heating element 70 can be for example, mount heaters, adhesive heaters, wrap-around heaters, cold plate heaters, mat heater or the like or the heaters can be incorporated into the reservoir. The heating element 70 can partially or fully encapsulate the reservoir. The reservoir 66 can further comprise a reservoir lid 67 wherein the lid can be placed or attached to the top of the reservoir and in certain embodiments the lid can be omitted. The reservoir 66 can be attached to a tube wherein the tube 56 can reach from the reservoir to the syringe tip 52 wherein the tube can be attached to the syringe tip allowing the liquid to flow from the reservoir to the syringe tip. The tube 56 can have one or more heating elements 54 attached to the outer diameter of the tube and it can extend from the reservoir 66 to the syringe tip 52, and it can be wrapped around or be incorporated into the syringe tip keeping the viscosity of the liquid low. The reservoir 66 can be any suitable reservoir or tank with an outlet at or near its bottom and made from any suitable material. In a preferred embodiment the reservoir 66 can be stainless steel or any non-rustable material.

The heating element 70 on the reservoir 66 is preferably capable of maintaining a temperature of the fluid inside the reservoir of at least between 60 to 125 degrees Celsius, more preferably at least 80 to 110 degrees Celsius, and still more preferably at least 85 degrees Celsius in an indoor environment which can be maintained at an ambient temperature of 22 degrees Celsius. The heating element 54 on the tube 56 is preferably capable of maintaining a temperature of the fluid inside the tubing and syringe of at least between 60 to 125 degrees Celsius, more preferably at least 70 to 110 degrees Celsius, and still more preferably at least 75 degrees Celsius. The heating element 70 on the reservoir 66, the tubing 56 and syringe 44 can be capable of temperatures of 0 degrees Celsius to 250 degrees Celsius.

One or more temperature sensors 72 can be placed in an array at different locations of the vaporizer cartridge filling device 10 such as, for example, top of reservoir 66, bottom of reservoir, inside of reservoir, outside of reservoir, top of tubing 56, middle of the tubing, bottom of tubing, syringe tip 52 thus allowing the user and the controller to track the temperature of the system allowing for consistent fluid temperature from the reservoir to the syringe tip. In other embodiments, the temperature sensor can read ambient temperature, motor 22 temperature, syringe body 51 temperature, syringe tip 52 temperature, and the like. The temperature sensor 72 can be, for example, thermocouple, thermistor, RTD, or the like and can be connected to a micro controller unit (MCU) 92. The MCU 92 can regulate the reservoir heating element 70, the tubing heating element 54 and in certain embodiments the syringe heating element The vaporizer cartridge filling device 10 can further comprise one or more switches wherein the switches can be an upper limit switch 60 and a lower limit switch 62. The upper limit switch 60 and lower limit switch 62 allows for position feedback of the dispensing end 36 which communicates to the MCU 92 which regulates the position of the syringe plunger 49 and switches the motor 22 from forward to reverse or from reverse to forward moving the syringe plunger up and down. The upper limit switch 60 can be attached to the support track 34 by one or more fasteners (not shown) above the carriage 37 and the lower limit switch 62 can be attached to the support track below the carriage. The upper limit switch 60 and lower limit switch 62 can be, for example, pin plunger, short straight lever, standard straight lever, button switch or the like. In certain embodiments the position can be located by a laser position sensor, contact position sensor, ultrasonic position sensor, linear variable differential, or the like. In other embodiments the limit switch can be set by the number of cycles the motor 22 makes wherein the MCU 92 can detect and regulate the motor's cycles as it rotates. The vaporizer cartridge filling device 10 can comprise any suitable enclosure (not shown) to cover the driving end 20 and the dispensing end 36 wherein the enclosure can provide the user access to adjust or fix any components within the device.

In some embodiments, the vaporizer cartridge filling device 10 can comprise a user interface 90 wherein the user interface can be a touch screen that can be connected to the MCU 92 which can be a standard programmable computer or controller wherein the computer can control the device as described herein and can be responsive to a user's input via a user interface 90. The vaporizer cartridge filling device 10 can further comprise an activation switch 94 as shown in FIG. 1 wherein the activation switch activates the motor 22 moving the syringe plunger 49 down thus dispensing the fluid within the syringe body 51. As the syringe plunger 49 moves back up it draws in more fluid from the reservoir thus filling the syringe body 47 with fluid. The activation switch 94 can be a foot pedal switch, button switch. In certain embodiments a finger switch can be attached to the frame 12 wherein the user can activate the device 10 by compressing the finger switch wherein the finger switch can be such as, for example, a panel switch, pendant switch, push button switch, or the like.

In a typical cycle, a load of liquid is withdrawn from the reservoir 66 by the syringe as the syringe plunger 49 moves in the syringe body 47 from its empty/closed position to its open/filled position the suction from moving the syringe plunger draws in the fluid from the reservoir. An empty cartridge (not shown) is placed under the syringe tip 52 by the user and the activation switch 94 is pushed activating the device 10 which moves the syringe plunger 49 back into the closed position dispersing the fluid into the cartridge. A valve prevents the fluid from flowing back into the reservoir 66 and air from being pulled through the dispensing end 36. Then on the upstroke the syringe body 47 refills from the hose 56, and then the operation is repeated. When the motor 22 is activated the number of rotations of the motor can set the stroke length of the syringe plunger 49. For example, one rotation can draw in or expel at least 0.01 mL to 15 mL, more preferably at least 0.05 to 5 mL, and still more preferably at least 1 mL of fluid from the syringe body 47, however, fluid flow and rates may vary with different size motors, threaded rods, and syringe bodies.

Figure 7:
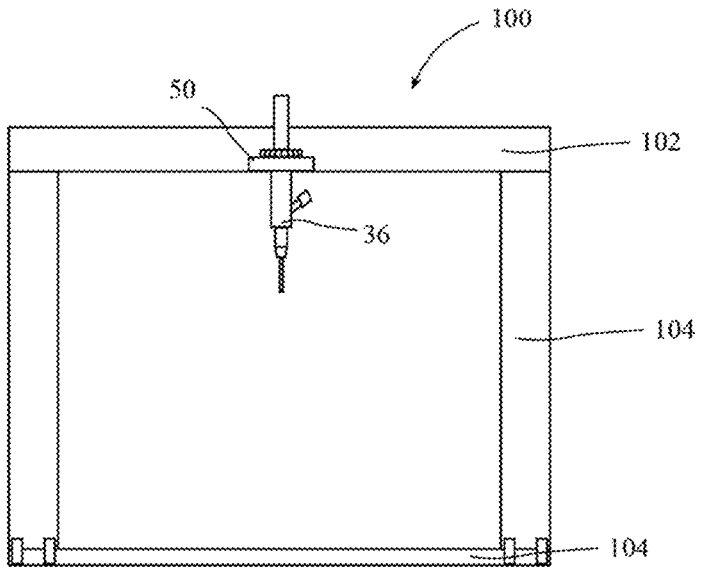
FIG. 7 is a front view of another embodiment of the vaporizer cartridge filling device in accordance to one, or more embodiments.

Referring to FIG. 7 another embodiment of a vaporizer cartridge filling device is shown generally at 100. The cartridge filling device 100 can comprise an upper member 202, and at least one supporting member 104 and a bottom member 106 wherein the upper member can be connected to the supporting member by at least one fastener. The upper member 102, supporting member 104 and the bottom member 106 can be, for example, 80/20 framing, steel framing, aluminum framing, or the like. The dispensing end 36 can be attached to the upper frame 102 by at least one fastener and a syringe support 50 wherein the dispensing end can have the same properties and components as the dispensing end in FIG. 1.

Figure 8:
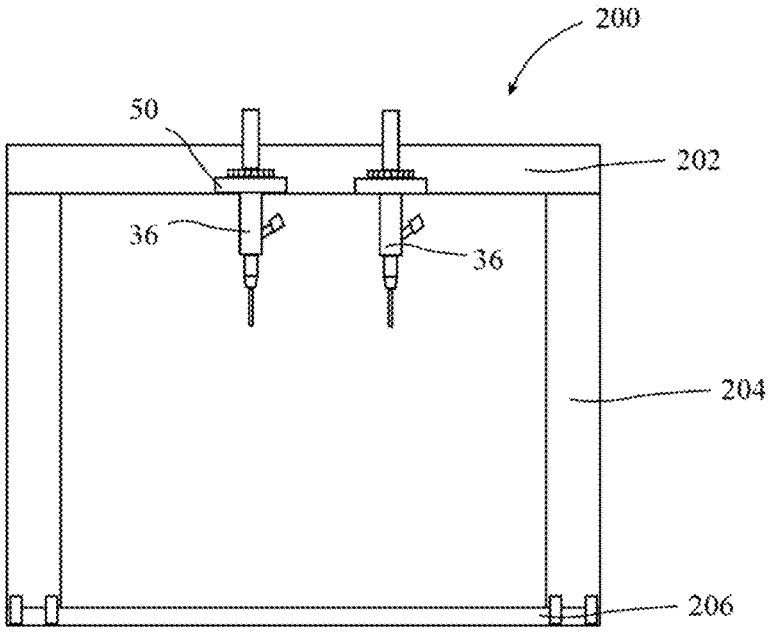
FIG. 8 is a front view of another embodiment of the vaporizer cartridge filling device in accordance to one, or more embodiments.

FIG. 8 shows another embodiment of a vaporizer cartridge filling device is shown generally at 200. The e-cigarette cartridge filling device 200 can comprise an upper member 202, and at least one supporting member 204 and a bottom member 204 wherein the upper member can be connected to the supporting member by at least one fastener. The upper member 202, supporting member 204 and the bottom member can be such as, for example, 80/20 framing, steel framing, aluminum framing, or the like. The dispensing end 36 can be attached to the upper frame 202 by at least one fastener and at least one syringe support 50 wherein the dispensing end can have the same properties and components as the dispensing end in FIG. 1.

Figure 9:
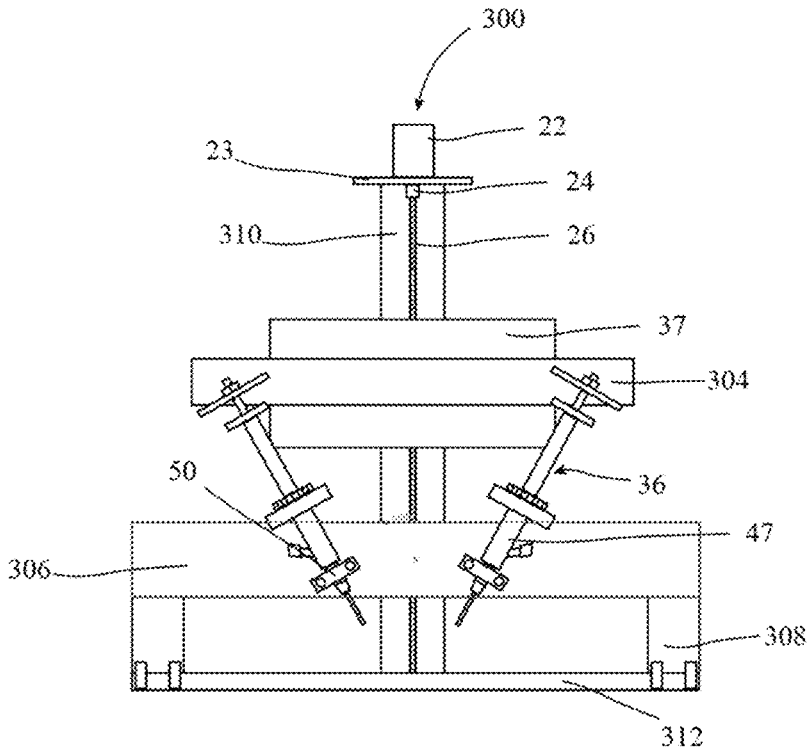
FIG. 9 is a front view of another embodiment of the vaporizer cartridge filling device in accordance to one, or more embodiments.

FIG. 9 shows yet another embodiment of a vaporizer cartridge filling device is shown generally at 300. The cartridge filling device 300 can comprise a motor 22 that can be attached to a motor support 23 wherein the motor support can be attached to a main member 310. The main member 310 can be attached a cross member 306 wherein the cross member can be supported by at least one supporting member 308. The motor 22 can be coupled to a threaded rod 26 wherein the threaded rod can move a carriage 37 that can have a syringe support 304 attached to it by one or more fasteners. The cartridge filler device 300 can further comprise at least one dispensing end 36 wherein the syringe body 47 can be attached to the cross member 306 and the plunger 49 can be attached to the syringe support wherein as the motor rotates the threaded rod 26 the carriage 302 and the syringe support move axially which in turns moves the plunger 49 releasing the liquid out of the syringe or filling the syringe body 47 with liquid. The syringe body 47 can be attached to the cross member 306 by one or more syringe support 50. The dispensing end 36 can be attached to the cross member 306 and the syringe support 304 at an angle wherein the angle can be between 20 degrees and 90 degrees, but more preferably between 30 degrees and 80 degrees. In certain embodiments the syringe support 50 can be on a rotation mechanism wherein the user can set the dispensing device at any angle between 0 degrees and 180 degrees wherein the user can release a pin and the dispensing unit 50 can rotate around the syringe support's axis. The dispensing end 36 can have the same properties and components as the dispensing end in FIG. 1.

Figure 10:
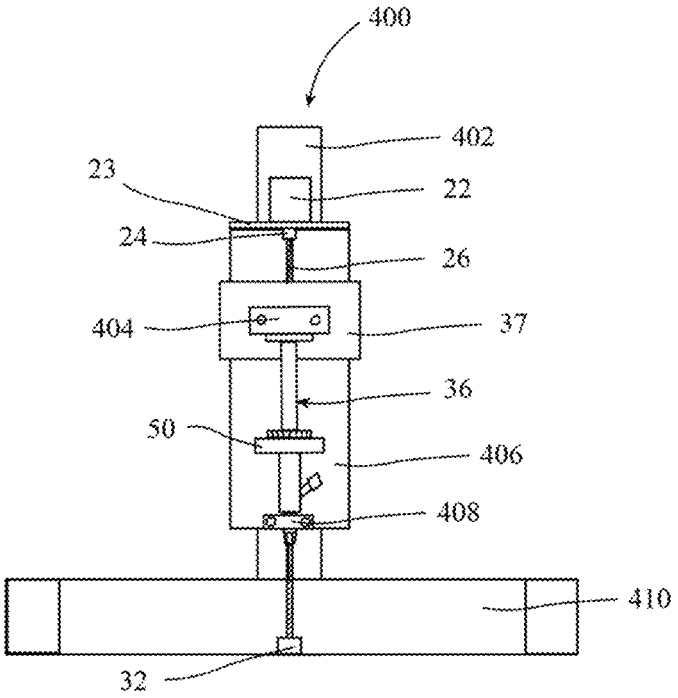
FIG. 10 is a front view of another embodiment of the vaporizer cartridge filling device in accordance to one, or more embodiments.

FIG. 10 shows another embodiment of a vaporizer cartridge filling device is shown generally at 400. The e-cigarette cartridge filling device 400 can comprise a main member 402, and at least one supporting member 410 wherein the main member can be connected to the supporting member by at least one fastener. The main member 402, supporting member 410 can be, for example, 80/20 framing, steel framing, aluminum framing, or the like. The cartridge filling device 400 can further comprise a motor 22 that can be attached to a motor support 23 wherein the motor support can be attached to a main member 402. The motor 22 can be coupled to a threaded rod 26 wherein the threaded rod can move a carriage 37 that can have a syringe support 404 attached to it by one or more fasteners. The cartridge filler device 400 can further comprise at least one dispensing end 36 wherein the syringe body 47 can be attached to a vertical support 406 by the syringe body and syringe support 50 wherein the motor 22 can move the dispensing end plunger releasing the liquid and drawing in the liquid from a reservoir. The dispensing end can have the same properties and components as the dispensing end in FIG. 1.

Referring to FIG. 11 a flow diagram for a vaporizer cartridge filling device is shown generally at 10. The MCU 92 can control a safety relay 98, which can turn off the power if anything goes wrong within the device. One or more solid-state relays 100, 102 can get fairly hot in use and fail shorted, so a safety relay 98 and inlet fuse 96 are included as safety features to turn off the system if the solid-state relays become too hot. Other features as shown in FIG. 11 are the creation of DC power forms 104 and the motor drive electronics package 105, which are typically provided by the motor vendor to suit the motor specifications.

The MCU 92 can calibrate the system by reading and encoding the syringe 44 position wherein a typical calibration cycle comprises the motor moving the syringe plunger to the top switch and then to the bottom switch reading/encoding the distance or rotations between the two switches wherein the bottom switch equates to an empty state and the top switch equates to a full state wherein the empty state can be 0 mL and the full state can be 10 mL of fluid and the MCU can save the calibration points for current or future use for varying syringe sizes. The user can input into the MCU 92 the volume of the syringe, accelerometer calibration settings, motor 22 settings such as size and voltage, thread pitch, sensor calibration, or the like.

The MSU 92 can control a PID controller which controls the reservoir temperature and the tube 56 temperature and can allow the user to set specified temperatures for varying fluids and viscosities. The MCU 92 can send and receive data from the user interface 90 wherein the user can input and set temperatures, rate, calibrate the system, purge the system, control sight light and ring lamp brightness, set and change speeds of motor, set viscosity of fluid, set volume of syringe body, set distances between the switches. The MCU 92 can detect when reservoir is empty and can be set to sound alarm or stop the filling cycle. The MCU 92 can be set to purge the reservoir, tubes and syringe wherein a typical purge cycle comprises automatically running the syringe to empty all of the fluid and then fill the reservoir with alcohol or other safe cleaning fluids, and then running the system through a cycle to allow the alcohol to be run through to clean and disinfect. The cycle will run until the alcohol has emptied from the reservoir and tubing.

The MCU 92 can further comprise programming that allows the user to bump the motor allowing for even more precise increments of at least 0.033 ml wherein normal increments are usually from at least 0.1 ml to at least 2 ml in at least 0.1 increments. The MCU 92 can additionally find its home position which can resets the syringe by finding the bottom resting point by activating the bottom switch which allows for a recalibration of the syringe volume. The MCU 92 programming can track the time it takes to fill each syringe and count of how much cartridges have been filled and the program can records data such as how much fluid is emptied into each cartridge and can assign a lot number, serial number, size of cartridge allowing for the user to keep track of the cartridges. The user can set at least 6 speeds 1×, 2×, 3×, 5×, 7×, 10×, but in other embodiments it can be more that 6 speeds, to allow for quicker cartridge filling. The MCU 92 can record the strain the motor 22 with see while going through its cycles while filling the cartridges wherein the MCU can record the motors strain and detect if there is an increase in strain allowing the MCU or user to adjust the temperature for the fluid to flow easier.

The MCU 92 can count the encoder 25 pulses for an independent count of the motor 22 rotation and therefore the syringe push block 38 linear position, and as a consequence, the syringe plunger 49 linear position. The MCU 92 can record accelerometer linear position information when the accelerometer is mounted on the syringe push block 38 or other components that travel with it. By enhancing dispensing accuracy, the user can optimize his profits by the out of cartridges. The MCU 92 can record relevant user information pertaining to the calibration and strain of the machine onto non-volatile memory or report it to a website database. For example, the encoder 25 counts, cycle time, temperatures and strain histories can be read to determine if the machine is having problems such as loose coupler, bad position indicator position, bad heaters or relays or user misuse.

A method for troubleshooting an e-cigarette vaporizer device comprising calibrating a device by computing the fraction of a mL of the dispensed amount by subtracting or adding a fraction of the mL from the calibrated dispense amount. The motor can be bumped which adds or subtracts the amount of the mL of fluid to get the calibrated amount. The mL can be substantially between 0.02 mL or 0.03 mL but can be at most 0.01 mL to at most 0.50 mL. Each bump of the motor is at least 20 motor pulses per bump.

A method for operating a vaporizer cartridge filling device, the method comprising the acts of providing a frame supporting a fluid dispenser, a microcontroller that controls the fluid dispenser and a user interface, the fluid dispenser comprising a reservoir that drains to a tube, a valve that allows the fluid to flow through the fluid dispenser in one directions, a syringe comprising a plunger, the syringe coupled to the tube and to a motor that is coupled to a threaded rod, wherein the plunger moves as the motor rotates the threaded rod. Calibrating a volume to be dispensed from the syringe by defining the volume by a lower limit of travel and an upper limit of travel of the plunger and running a program that sets at least one of the lower limit and the top limit using positional feedback to precisely control the volume. Saving at least one of the lower limit and the upper limit defining the volume. Loading the fluid into the reservoir. Setting a speed to dispense the volume of fluid from the syringe; wherein moving the plunger from the lower limit to the upper limit draws the liquid from the reservoir to the syringe and moving the plunger back to the lower limit dispenses the fluid from the syringe. Activating at least one of the draw and the dispensation of the fluid by operating a switch that initiates movement of the plunger. Loading a cleaning solution into the reservoir through the reservoir and supply tube and allowing the fluid dispenser to continuously purge the system with the cleaning solution until the reservoir is empty or for a predetermined time period.

The cleaning solution is alcohol but can be any suitable solution. The speed is set to 1×, 2×, 3×, 5×, 7×, 10× and can increase in increments up to at least 100×. The vaporizer device can detect a strain on the motor by detecting a viscosity of the fluid wherein the strain on the motor increases with higher viscosity fluid. The vaporizer device can dispense the volume precisely into a cartridge using a shaft encoder to independently count pulses. The vaporizer device can an accelerometer and computing linear displacement by integrating an accelerometer for precisely dispensing the volume into the cartridge. The vaporizer device can use a linear position reader based on a resistive potentiometer reader, inductive reader, encoded magnetic strip reader or optical strip reader.

A method for troubleshooting a vaporizer device, the method comprising the acts of calibrating the device by computing a desired volume to dispense by subtracting or adding a fraction of the volume from the calibrated dispense volume. Bumping a motor which adds or subtracts the amount of the volume of fluid by the calibrated amount. The method for troubleshooting a vaporizer device wherein the volume is 0.02 mL or 0.03 mL. The method for troubleshooting a vaporizer device wherein each bump of the motor is at least 20 motor pulses per bump.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

The invention claimed is:

1. A vaporizer cartridge filling device comprising:

a frame supporting a fluid dispenser, a microcontroller that controls the fluid dispenser and a user interface, the fluid dispenser comprising a reservoir that drains to a tube, a syringe comprising a plunger, the syringe coupled to the tube and to a motor that is coupled to a threaded rod, wherein the plunger moves as the motor rotates the threaded rod; and a bottom switch and a top switch that is attached to the frame wherein a carriage can contact, activate, and deactivate the bottom switch and top switch setting a bottom limit and a top limit.

2. The vaporizer cartridge filling device according to claim 1, wherein the motor is a stepper motor.

3. The vaporizer cartridge filling device according to claim 1, wherein the syringe further comprises a syringe body and syringe tip wherein the syringe body and syringe tip is stationary, and the syringe plunger moves inside of the syringe body.

4. The vaporizer cartridge filling device according to claim 1, wherein the micro-controller receives input from the bottom switch and the top switch and calibrates the volume dispensed by the plunger.

5. The vaporizer cartridge filling device according to claim 1, wherein the micro-controller unit runs a cleaning cycle wherein the motor moves the syringe plunger until a cleaning solution is flushed through the reservoir, the tube, and the syringe body.

6. The vaporizer cartridge filling device according to claim 1, further comprising a first heating element in contact with the reservoir and a second heating element in contact with the tube, wherein the first heating element is set to 85 degrees C. and the second heating element is set to 75 degrees C.

7. A method for operating a vaporizer cartridge filling device, the method comprising the acts of:

providing a frame supporting a fluid dispenser, a microcontroller that controls the fluid dispenser and a user interface, the fluid dispenser comprising a reservoir that drains to a tube, a valve that allows the fluid to flow through the fluid dispenser in one directions, a syringe comprising a plunger, the syringe coupled to the tube and to a motor that is coupled to a threaded rod, wherein the plunger moves as the motor rotates the threaded rod;

calibrating a volume to be dispensed from the syringe by defining the volume by a lower limit of travel and an upper limit of travel of the plunger and running a program that sets at least one of the lower limit and the top limit using positional feedback to precisely control the volume;

saving at least one of the lower limit and the upper limit defining the volume;

loading the fluid into the reservoir;

setting a speed to dispense the volume of fluid from the syringe; wherein moving the plunger from the lower limit to the upper limit draws the liquid from the reservoir to the syringe and moving the plunger back to the lower limit dispenses the fluid from the syringe;

activating at least one of the draw and the dispensation of the fluid by operating a switch that initiates movement of the plunger; and loading a cleaning solution into the reservoir and allowing the fluid dispenser to continuously purge the system with the cleaning solution until the reservoir is empty or for a predetermined time period.

8. The method for operating a vaporizer device according to claim 7, wherein the cleaning solution is alcohol.

9. The method for operating the vaporizer device according to claim 7, wherein the speed is set to 1x, 2x, 3x, 5x, 7x, 10x.

10. The method for operating a vaporizer device according to claim 7, further comprising detecting a strain on the motor by detecting a viscosity of the fluid wherein the strain on the motor increases with higher viscosity fluid.

11. The method for operating a vaporizer device according to claim 7, further comprising dispensing the volume precisely into a cartridge using a shaft encoder to independently count pulses.

12. The method for operating a vaporizer device according to claim 11, further comprising using an accelerometer and computing linear displacement by integrating an accelerometer for precisely dispensing the volume into the cartridge.

13. The method for operating a vaporizer device according to claim 11, further comprising using a linear position reader based on a resistive potentiometer reader, inductive reader, encoded magnetic strip reader or optical strip reader.

* * * * *